US007056174B2

(12) United States Patent
Yokoya et al.

(10) Patent No.: US 7,056,174 B2
(45) Date of Patent: Jun. 6, 2006

(54) DRAINAGE STRUCTURE OF EXHAUST RESONATOR

(75) Inventors: Noboru Yokoya, Wako (JP); Takeshi Kimishima, Wako (JP); Yasunori Okazaki, Wako (JP); Takeshi Koyabu, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/902,968

(22) Filed: Jul. 30, 2004

(65) Prior Publication Data

US 2005/0042950 A1 Feb. 24, 2005

(30) Foreign Application Priority Data

Aug. 19, 2003 (JP) ..... 2003-295223
Aug. 20, 2003 (JP) ..... 2003-296566

(51) Int. Cl.
*B63H 21/32* (2006.01)

(52) U.S. Cl. ..... 440/89 J; 440/89 R

(58) Field of Classification Search ..... 440/89 J, 440/89 R, 89 B, 89 C, 89 F, 89 H
See application file for complete search history.

(56) References Cited

U.S. PATENT DOCUMENTS 4,019,456 A * 4/1977 Harbert ..... 440/88 R
5,433,634 A * 7/1995 Nakayama et al. ..... 440/1
5,746,630 A * 5/1998 Ford et al. ..... 440/89 R
6,019,648 A 2/2000 Lecours et al.
6,077,135 A * 6/2000 Ito ..... 440/83
6,226,984 B1 * 5/2001 Ford ..... 60/310
2003/0121253 A1 * 7/2003 Ford et al. ..... 60/310

FOREIGN PATENT DOCUMENTS

| | | |
|---|---|---|
| JP | 2000-118488 | 4/2000 |
| JP | 2000-264288 | 9/2000 |
| JP | 2000-280982 | 10/2000 |
| JP | 2003-72688 | 3/2003 |

* cited by examiner

*Primary Examiner*—Ed Swinehart
(74) *Attorney, Agent, or Firm*—Hamre, Schumann, Mueller & Larson, P.C.

(57) ABSTRACT

The invention is directed at increasing the degree of freedom in layout of the resonator, and the exhaust system including the resonator will be improved. Also, the invention is directed at a resonator and exhaust system wherein when an attempt is made to raise the engine speed from the idling state, the engine speed will be smoothly raised. According to the invention, there is provided a bilge pump for draining water within a hull; cooling water is caused to flow within an exhaust pipe of an engine; and in the exhaust system, there is provided a resonator. The resonator is connected to the bilge pump through bilge pipes. The bilge pump is constructed of a jet propulsion pump to be driven by the engine. Even if the resonator is arranged below the water line, the water which accumulates within the resonator will be drained by the bilge pump, and it becomes possible to arrange the resonator below the water line without interfering with the function of the resonator.

5 Claims, 9 Drawing Sheets

DRAINAGE STRUCTURE OF EXHAUST RESONATOR

CROSS REFERENCE TO RELATED APPLICATIONS

This application is based on Japanese Patent Nos. 2003-295223 and 2003-296566.

TECHNICAL FIELD

The present invention relates to drainage structure of an exhaust resonator in a ship.

BACKGROUND OF THE INVENTION

There is known a ship having an electric bilge pump for draining water within a hull that includes a bilge pipe and other structures that connect an exhaust chamber of an engine and the electric bilge pump such that when water not less than a predetermined amount has accumulated within the exhaust chamber, the electric bilge pump can be driven to drain the water within the exhaust chamber. See, for example, Japanese Patent No. 2000-264288.

In addition, there is also known a ship having a resonator in an exhaust system of an engine with a water muffler having an expansion chamber into which exhaust gas and water flow, and also having an exhaust/drainage pipe for discharging the exhaust gas and water within this expansion chamber. See, for example, U.S. Pat. No. 6,019,648, Japanese Patent No. 2000-118488, Japanese Patent No. 2000-280982.

DISCLOSURE OF THE INVENTION

In conventional ships, exhaust gas and water can flow into the water muffler, and the exhaust gas and water are discharged through an exhaust/drainage pipe, but since an aperture within the water muffler of the exhaust/drainage pipe is opened above a bottom within the water muffler by a predetermined amount, water can accumulate up to the lower part of the aperture within the water muffler even while the engine is operating.

While the engine is in an idling state, the exhaust force from the engine becomes weak, therefore, the water often accumulates in the water muffler until the aperture is substantially blocked with water.

When an attempt is made to raise engine speed from such a condition, that is, the idling state, the water in the water muffler inhibits the smooth rise of the engine speed.

When water accumulates in a resonator, the effectiveness of the resonator is degraded. Conventionally, it has been necessary to arrange the structure of the ship such that the resonator is arranged above the water line so that water discharges naturally from the resonator.

Accordingly, the layout of the resonator and an exhaust system device is limited. It is an object of the present invention to improve a degree of freedom with respect to the layout of the resonator and the exhaust system. It is also an object of the present invention to solve the above-described problem and to make it possible to smoothly raise the engine speed when an attempt is made to raise the engine speed from the idling state.

SUMMARY OF THE INVENTION

According to the present invention, there is provided a drainage structure of an exhaust resonator in a ship in which there is also provided a bilge pump for draining water within a hull. The resonator is connected to the bilge pump through a bilge pipe. In some embodiments the bilge pump is constructed of a jet propulsion pump to be driven by the engine.

In the drainage structure of an exhaust resonator according to the present invention, the resonator is connected to the bilge pump through a bilge pipe such that even if the resonator is arranged below the water line, the water which accumulates within the resonator will be drained by the bilge pump.

Therefore, it becomes possible to arrange the resonator below the water line without interfering with (or degrading) the function of the resonator, and as a result, the degree of freedom in layout of the resonator and the exhaust system device including the resonator can be markedly improved.

Also, when the bilge pump is constructed of the jet propulsion pump to be driven by the engine, since the water which is going to accumulate within the resonator is to be drained in synchronism with an operation of the engine when the engine is operating, it becomes possible to effectively secure the function of the resonator, which is means for reducing noise when the engine is operating, in synchronism with the operation of the engine.

The drainage structure of a water muffler can also include a water muffler having an expansion chamber into which exhaust gas and water flow, and an exhaust/drainage pipe for discharging the exhaust gas and water within this expansion chamber, wherein the water muffler is provided with a drainage pipe and this drainage pipe is connected to the pump; and an aperture within the water muffler of this drainage pipe has been opened between the bottom within the water muffler and the upper end portion of the aperture within the water muffler of the exhaust/drainage pipe.

In some embodiments the upper end of aperture within the water muffler of the drainage pipe is located at the substantially same height as the lower end portion of the aperture within the water muffler of the exhaust/drainage pipe or at a higher height.

DETAILED DESCRIPTION OF THE INVENTION

Figure 1:
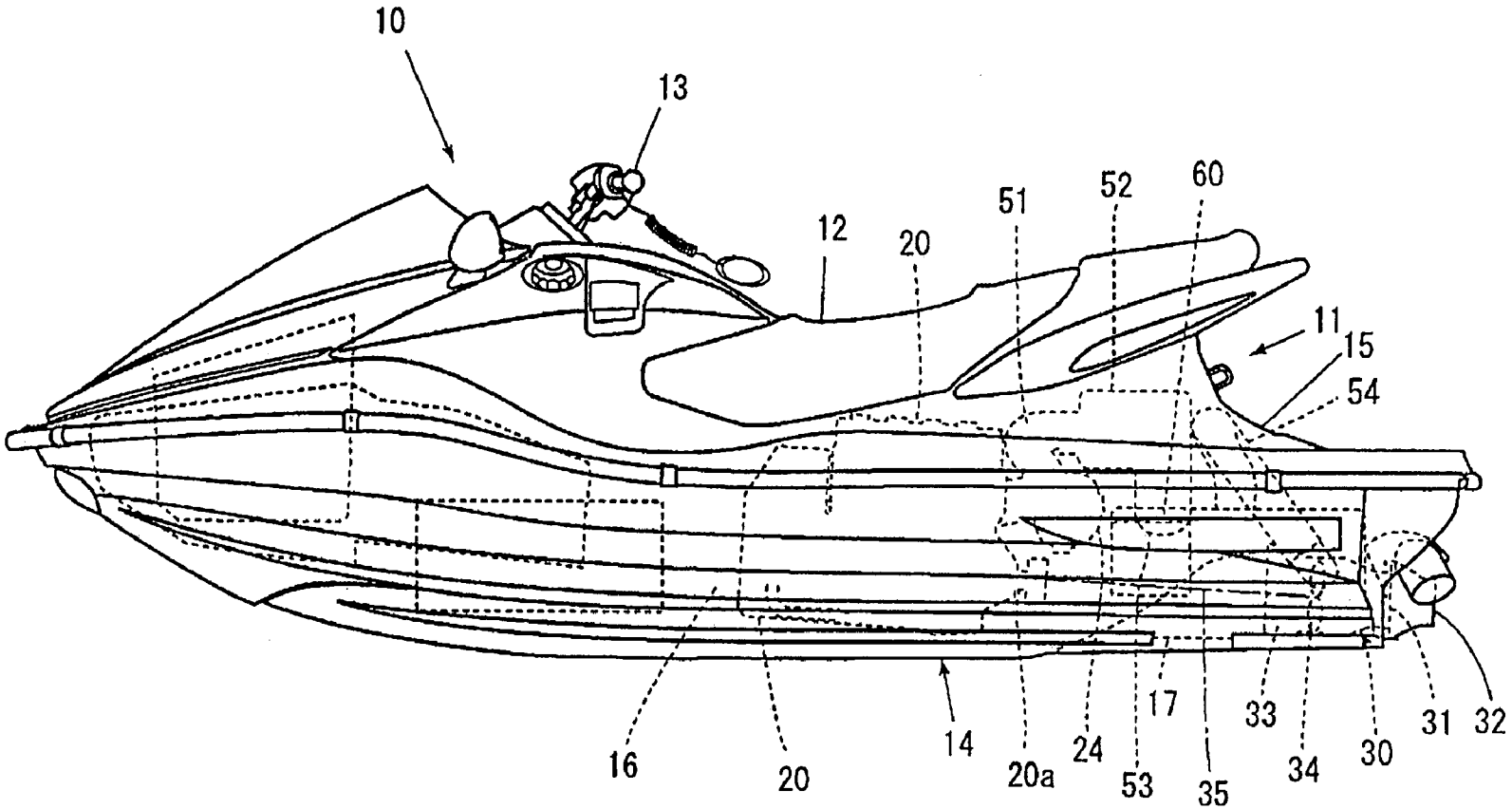
FIG. 1 is a schematic side view showing a small boat as an example of a ship suitable to apply the drainage structure of an exhaust resonator according to an embodiment of the present invention.

As shown in FIG. 1, this small boat 10 is a saddle mounting type small boat, and crews sit on seats 12 on the hull 11, and are capable of navigating by holding a steering wheel 13 with a throttle lever.

The hull 11 is a floating body structure, in which space 16 is formed therein by joining the hull 14 and a deck 15 together. Within the space 16, on the hull 14, there is mounted an engine 20, and a jet propulsion pump (hereinafter, referred to also as jet pump) 30 as propulsion means to be driven by this engine 20 is provided in the rear part of the hull 14.

Figure 2:
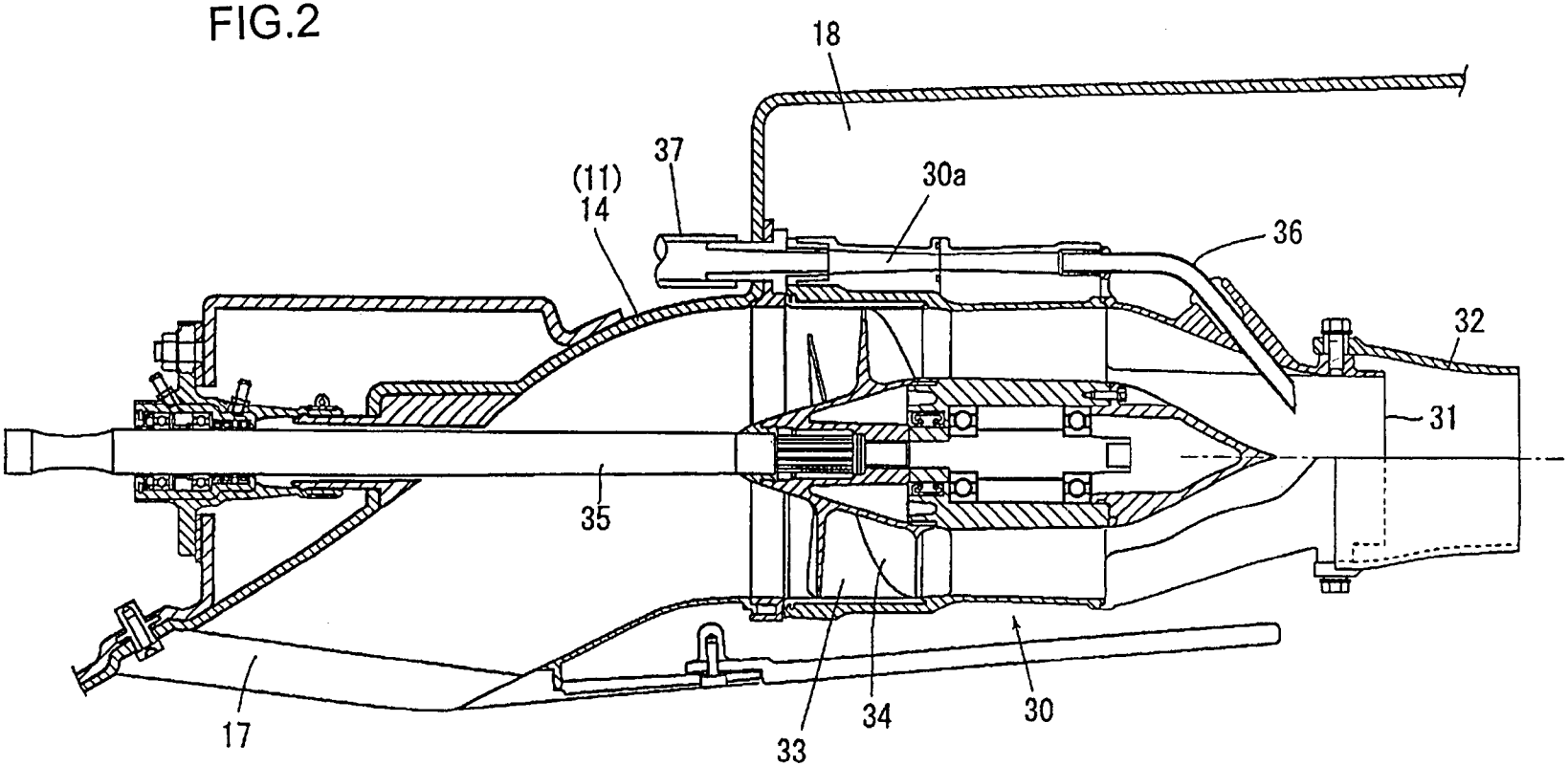
FIG. 2 is an enlarged cross-sectional view showing a jet propulsion pump and its surroundings.

Referring to FIG. 2, the jet pump 30 has a channel 33 reaching from an intake 17 opened in a ship's bottom to a jet port 31 opened at a rear end of the hull and a deflector 32, and an impeller 34 arranged within this channel 33. A shaft 35 of the impeller 34 is coupled to an output shaft 20*a* (See FIG. 1) of the engine 20. Therefore, when the impeller 34 is rotationally driven by the engine 20, water taken in from the intake 17 is jetted via the deflector 32 from the jet port 31, whereby the hull 11 is propelled. A driving number of revolutions of the engine 20, that is, a propulsion force by the jet pump 30 is operated under rotary control of a throttle lever (not shown) of the steering wheel 13. The deflector 32 is linked with the steering wheel 13 with an operating wire (not shown), and is rotationally controlled by operating the steering wheel 13 to change the course of the boat 10.

Still referring to FIG. 2, in the jet pump 30 there has been inserted a bilge pipe 36 for discharging bilge water in the ship's bottom. Therefore, the jet pump 30 constitutes the bilge pump. The second portion of the bilge pipe 36 is connected to the first portion of the bilge pipe 37 via the channel 30*a* formed in the upper part of the jet pump 30, and the first portion of the bilge pipe 37 is opened in the ship's bottom to drain the bilge water in the ship's bottom into the jet water flow within the jet pump 30.

Figure 3B:
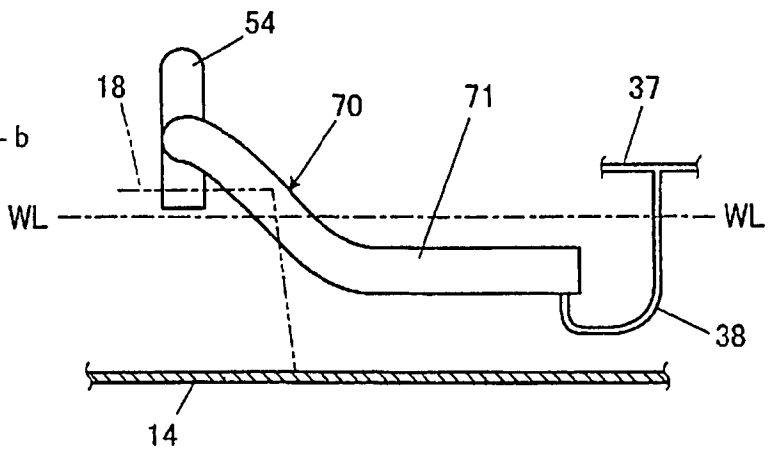
FIG. 3(*a*) is a schematic view showing the exhaust system as viewed from behind the small boat, and FIG. 3(*b*) is a view taken along the arrow b of FIG. 3(*a*)
Figure 3A:
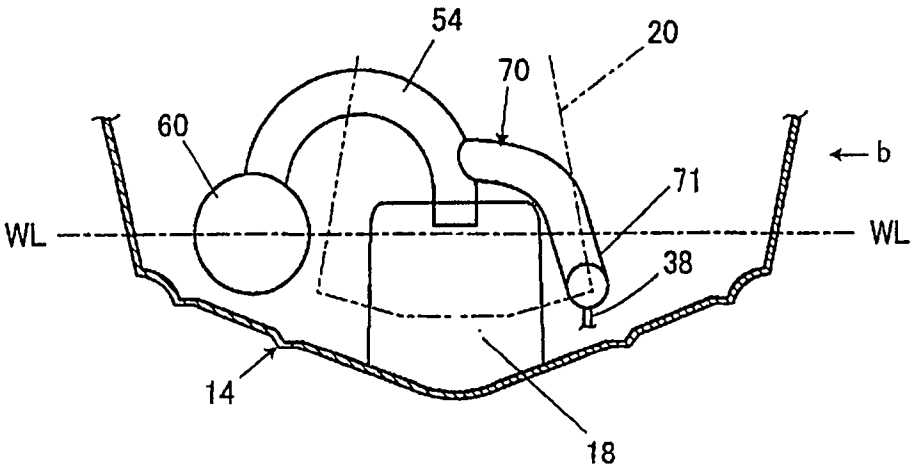

Referring to FIG. 3, the first portion of the bilge pipe 37 includes a branch pipe 38 that is connected to a resonator to be described in more detail later.

Referring back to FIG. 1, the engine 20 is a DOHC type, dry sump system four cycle engine having series four cylinders. The engine 20 has a crankshaft or output shaft 20*a* that is arranged to run along a longitudinal direction of the hull 11. In the rear part of the engine 20, there is arranged a turbo-charger 24. Connected to the turbine part of the turbo-charger 24 is an exhaust outlet of an engine exhaust manifold.

Figure 4:
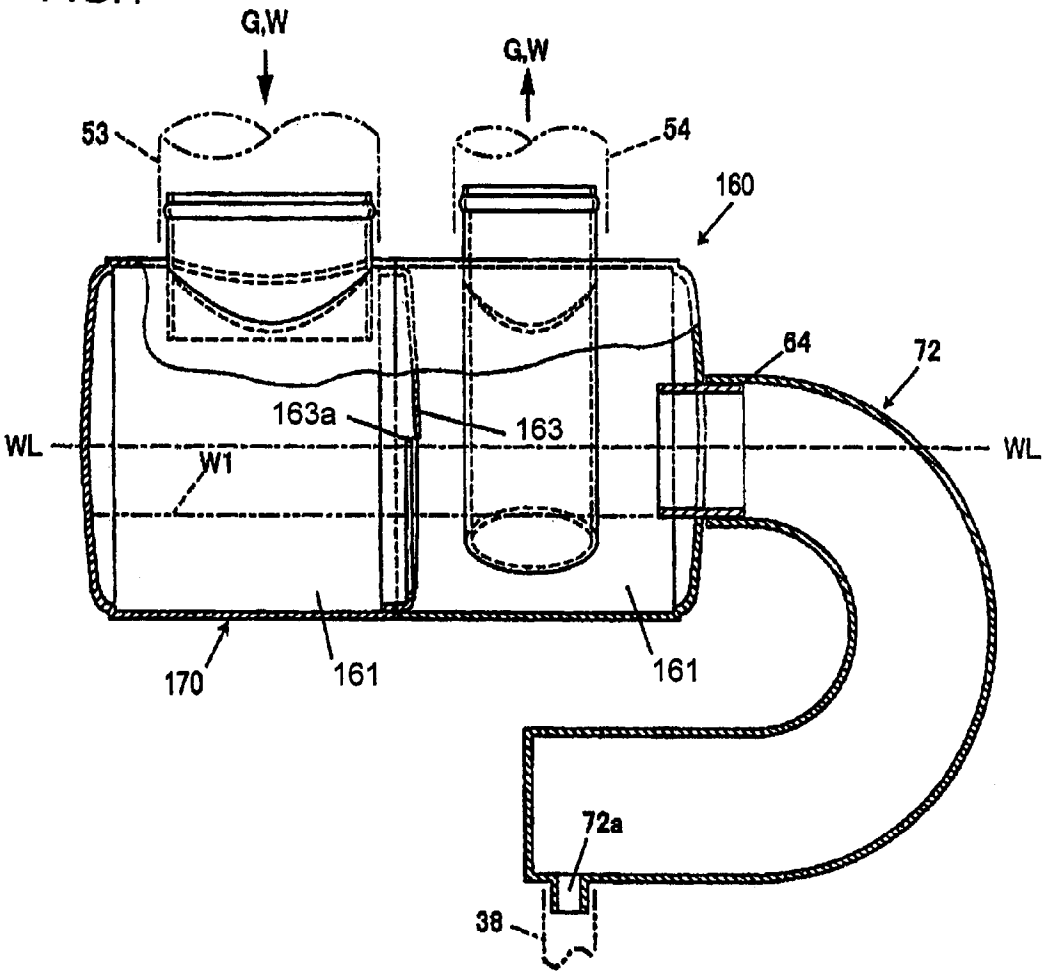
FIG. 4 is a partial cutaway side view showing a second example of the water muffler and the resonator.
Figure 8:
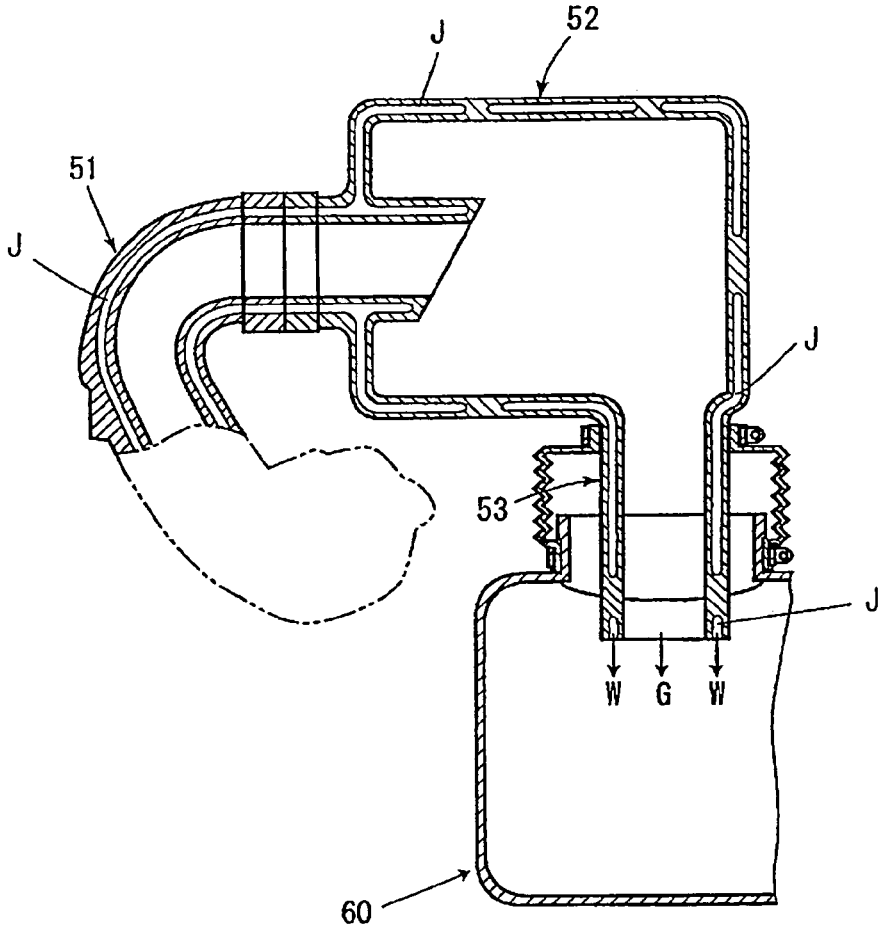
FIG. 8 is a partial omitted cross-sectional view showing the exhaust system; and, FIGS. 9(*a*) and 9(*b*) are views showing the water muffler.

Referring to FIGS. 1, 4, and 8, exhaust gas which has rotated a turbine in the turbine part of the turbo-charger 24 is discharged into a water muffler 60 through a first exhaust pipe 51 and a counter-flow prevention chamber 52 for preventing a counter-flow (intrusion of water to the turbo-charger 24 and the like) of water during capsizing, each of which is provided a water jacket J through which cooling water is caused to flow respectively, and a second exhaust pipe 53, and is further discharged from the water muffler 60 to a pump chamber 18 (shown in FIG. 3) in which the jet pump 30 has been housed and which has been opened outside the boat, via the exhaust/drainage pipe 54.

Accordingly, exhaust gas from the engine 20 is to be discharged outside the boat via the water muffler 60 and the exhaust/drainage pipe 54 through the exhaust pipe (in the present embodiment, the first exhaust pipe 51, the counter-flow prevention chamber 52 and the second exhaust pipe 53) having the water jacket J together with the water which has passed through the water jacket J.

FIG. 3(*a*) is a schematic view showing such an exhaust system as described above as viewed from behind a small boat 10, and FIG. 3(*b*) is a view taken along the arrow b of FIG. 3(*a*).

In FIG. 3, reference numeral 70 designates the resonator, and this resonator 70 is coupled to an exhaust/drainage pipe 54, one portion 71 of which is located below a water line WL.

At a bottom of the resonator 70, the above-described bilge pipe 38 is connected, and this bilge pipe 38 is connected to a jet pump 30, which constitutes the bilge pump, via the bilge pipe 37 as described above.

Therefore, when the engine is operating (that is, when the jet pump 30 is being driven), the water which is going to accumulate within the resonator 70 is to be drained into the jet water flow due to the jet pump 30 through the bilge pipes 38 and 37. In this respect, at least one of the bilge pipes 37 and 38 is located above the water line WL. A shape and layout place of the resonator can be freely set as explained below by giving a few examples.

FIG. 4 is a partial cutaway side view showing a second example of the water muffler 160 and the resonator. This water muffler 160 has an expansion chamber 161, and to this expansion chamber 161, the exhaust pipe 53 and the exhaust pipe 54 are connected. As described above, the exhaust gas G and the cooling water W are introduced from the exhaust pipe 53 within the water muffler 160, and are discharged from the water muffler 160 outside the boat through the exhaust pipe 54.

In the water muffler 160, between the exhaust pipe 53 and the exhaust pipe 54, there is provided a water restraining plate (partial partition plate) 163, the lower half of which has been opened in a substantially semicircular shape, which partitions the upper side within the expansion chamber 161.

In FIG. 4, W1 represents a water surface of the water which has been discharged within the water muffler 160 together with the exhaust gas from the exhaust pipe 53. An upper end 163*a* of the aperture of the water restraining plate 163 is located above the water surface W1. In the rear part of the water muffler 160, there is provided a communication pipe 64, and to this communication pipe 64, the resonator 72 is connected. At the bottom of the resonator 72, there is provided a connecting pipe 72*a* with the above-described bilge pipe 38, and to this connecting pipe 72*a*, the bilge pipe 38 is connected. In this respect, such a connecting pipe 72*a* is also provided on the above-described resonator 70 (See FIG. 3).

Since a communication pipe 64 is located above the water surface W1 within the water muffler 160, it is difficult for water to enter the resonator 72, but water may enter the resonator 72 by rocking or the like of the small boat 10. However, when the engine is operating (that is, when the jet pump 30 is being driven), the water which is going to accumulate within the resonator 72 is drained into the jet water flow due to the jet pump 30 through the bilge pipes 38 and 37.

Figure 5A:
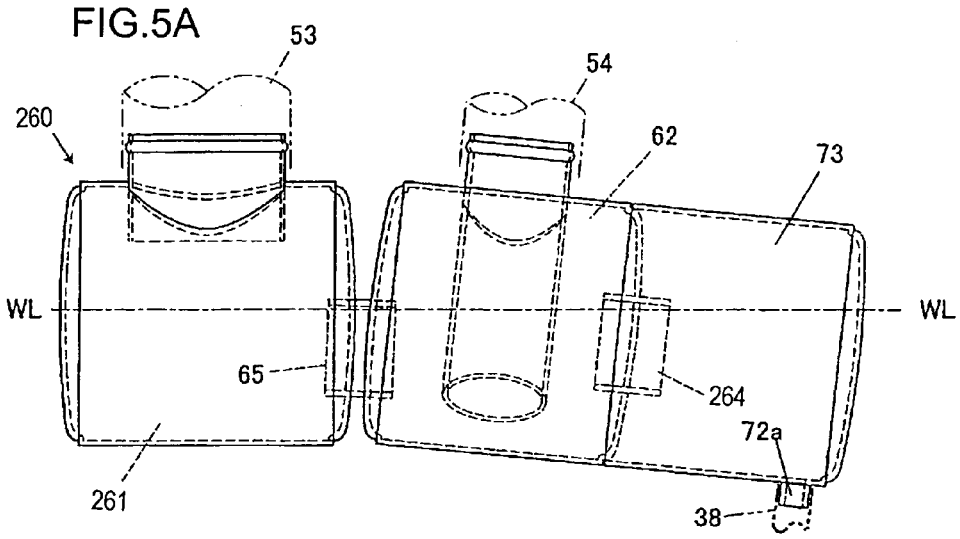
FIG. 5(*a*) is a side view showing a third example of the water muffler 60 and the resonator, and FIG. 5(*b*) is a side view showing a fourth example of the resonator.
Figure 5B:
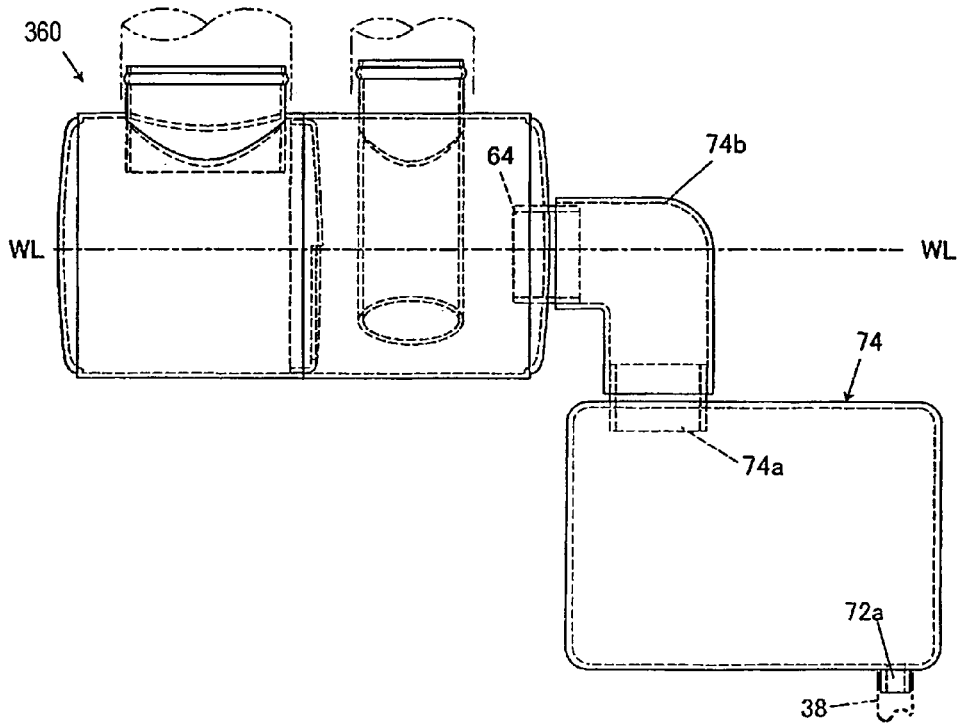

FIG. 5(*a*) is a side view showing a third example of the water muffler 260 and the resonator. In this water muffler 260, an expansion chamber 261 to which an exhaust pipe 53 is connected, and an expansion chamber 62 to which an exhaust pipe 54 is connected are individually formed, and these expansion chambers 261 and 62 are caused to communicate with each other through a communication pipe 65.

Thus, to one expansion chamber 62, a resonator (resonator chamber) 73 is integrally coupled, and the expansion chamber 62 and the resonator 73 are caused to communicate with each other through a communication pipe 264. One expansion chamber 62 and the resonator 73 are provided obliquely downward, and to a connecting pipe 72*a* at the bottom of the resonator 73, the bilge pipe 38 is connected.

FIG. 5(*b*) is a side view showing a fourth example of the resonator. A water muffler 360 is the same as the water muffler 160 shown in FIG. 4.

A resonator 74 is constructed as a completely separate resonator chamber from the water muffler 360, and via a communication pipe 64 on the water muffler 360 side, a communication pipe 74*a* on the resonator 74 side and a coupling pipe 74*b*, the water muffler 360 and the resonator 74 are coupled. At the bottom of the resonator 74, there is connected a bilge pipe 38.

Figure 6A:
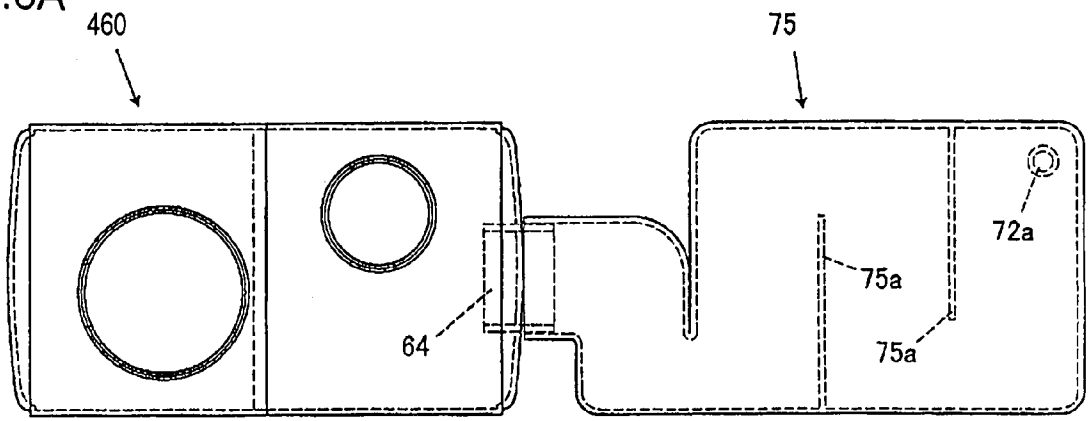
FIG. 6(*a*) is a plan view of a fifth example of the resonator, and FIG. 6(*b*) is a side view of the fifth example of the resonator.
Figure 6B:
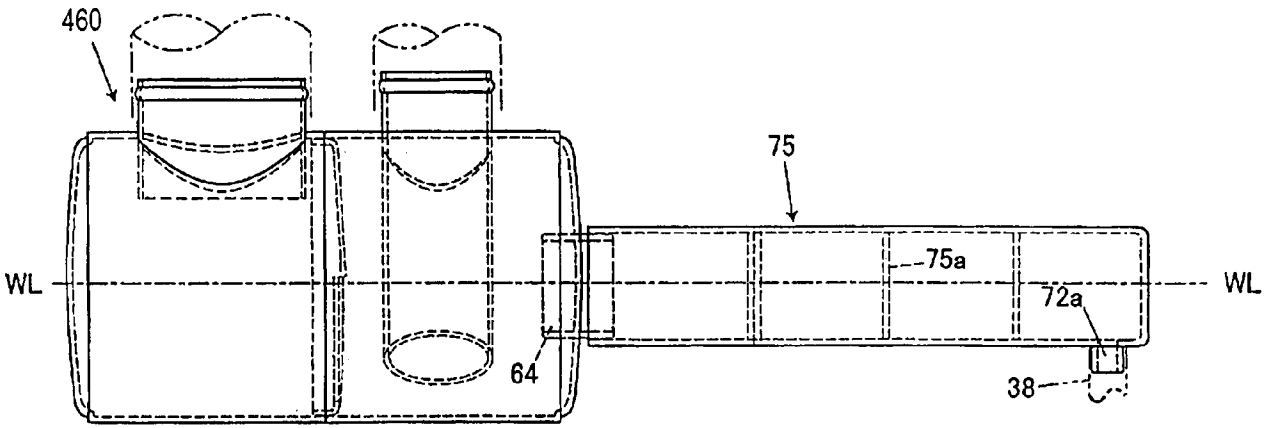

FIGS. 6(*a*) and 6(*b*) are views showing a fifth example of the resonator, FIG. 6(*a*) is a plan view, and FIG. 6(*b*) is a side view. A water muffler 460 is the same as the water muffler 60 shown in FIG. 4.

A resonator 75 is connected to a water muffler 460 through a communication pipe 64, and the internal space is partitioned zigzag with partition plates 75*a*. Since at the bottom of the resonator 75, there is connected a bilge pipe 38, the resonator 75 can be also inclined such that the connecting pipe 72*a* side becomes downward as in the case of FIG. 5(*a*).

Figure 7A:
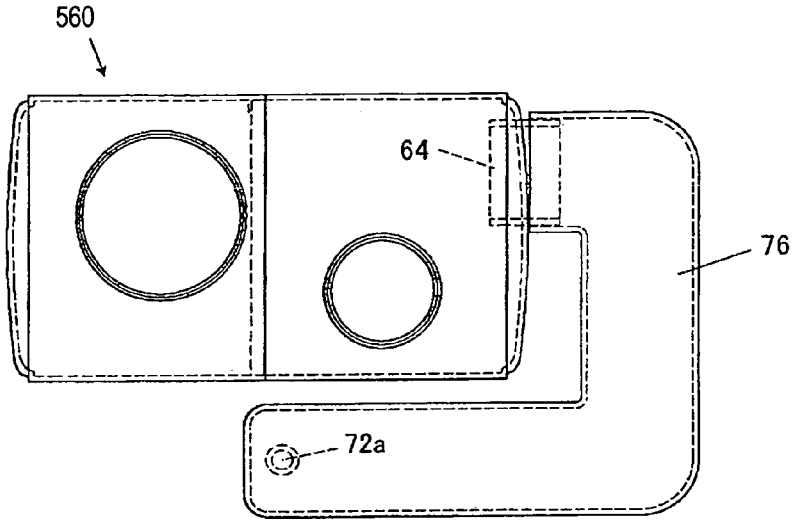
FIG. 7(*a*) is a plan view showing a sixth example of the resonator, and FIG. 7(*b*) is a plan view showing a seventh example of the resonator.
Figure 7B:
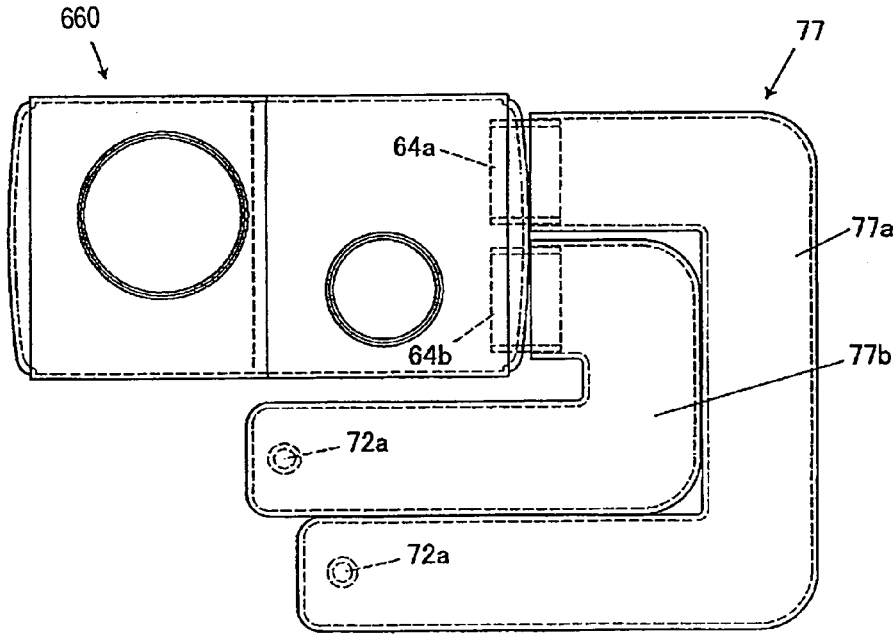

FIG. 7(*a*) is a plan view showing a sixth example of the resonator. A water muffler 560 is the same as the water muffler 160 shown in FIG. 4.

A resonator 76 is shaped like a substantially U-character by plane sight, and is connected to the water muffler 560 through a communication pipe 64. At the bottom of the resonator 76, there is provided a connecting pipe 72*a*.

FIG. 7(*b*) is a plan view showing a seventh example of the resonator. A water muffler 660 is the same as the water muffler 160 shown in FIG. 4.

A resonator 77 is constructed by connecting two resonators 77*a*, 77*b*, shaped like a substantially U-character by plane sight to the water muffler 660 through communication pipes 64*a*, 64*b* respectively. At the bottom of the resonator 77*a*, 77*b*, a connecting pipe 72*a* is provided respectively.

In such drainage structure of an exhaust resonator, since the resonator is connected to the bilge pump 30 through bilge pipes 37, 38, even if the resonator is arranged below the water line WL, the water which is going to accumulate within the resonator will be drained by the bilge pump 30.

Therefore, it becomes possible to arrange the resonator below the water line WL without interfering with (or degrading) the function of the resonator, and as a result, the degree of freedom in layout of the resonator and the exhaust system device including the resonator can be markedly improved.

In other words, the shape and layout of the resonator can be freely set in accordance with space and the like within the hull 14 without caring about the water line WL.

Also, since the bilge pump is constructed of the jet propulsion pump 30 to be driven by the engine 20, the water which is going to accumulate within the resonator is to be drained in synchronism with an operation of the engine when the engine 20 is operating. Therefore, it becomes possible to effectively secure the function of the resonator, which is means for reducing noise when the engine is operating, in synchronism with the operation of the engine.

Figures 9A, 9B:
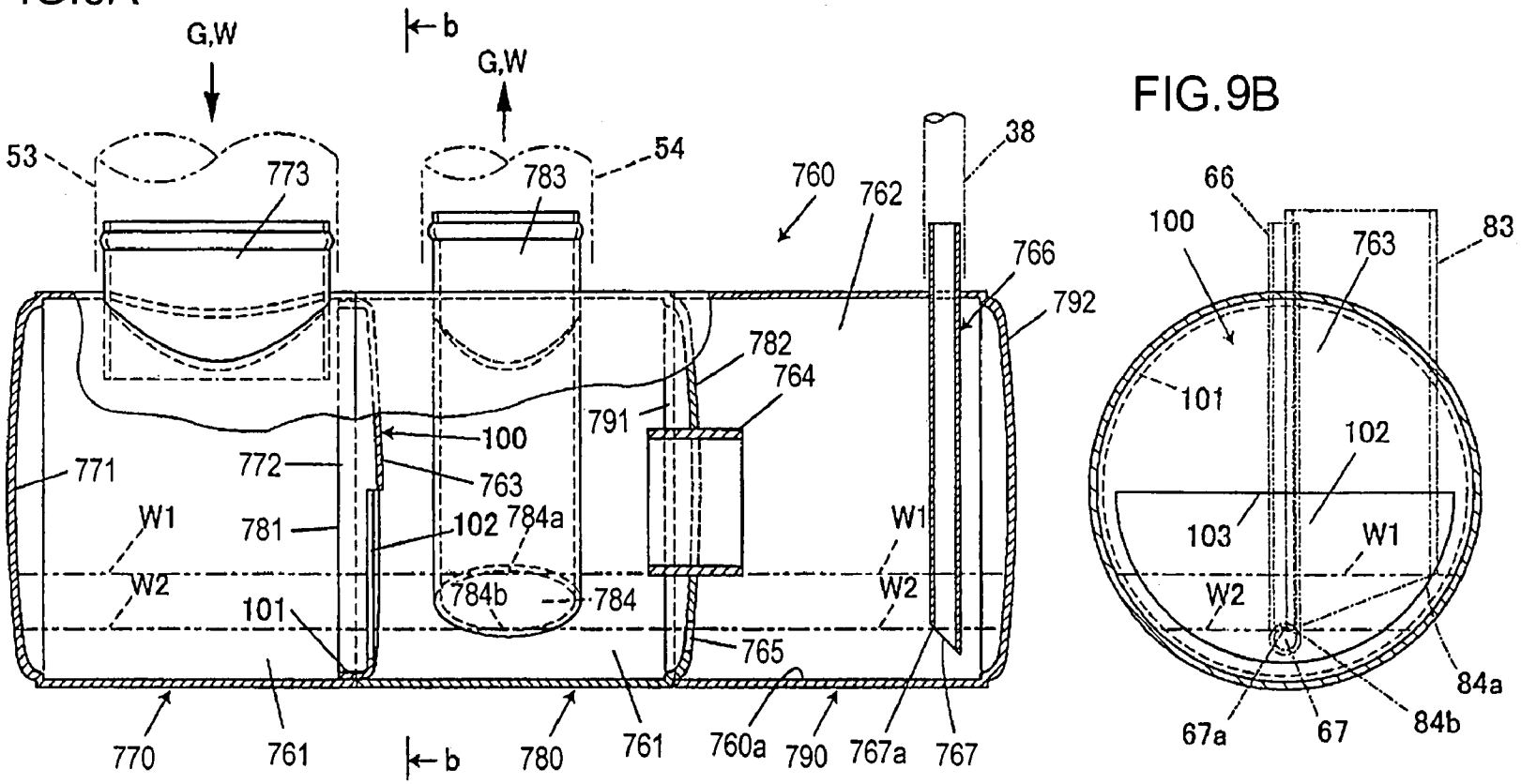
FIG. 9(*a*) is a partial cutaway side view, and FIG. 9(*b*) is a partial omitted cross-sectional view taken on line b—b in FIG. 9(*a*).

Referring to FIGS. 9*a* and 9*b*, a water muffler 760 is shown. The interior of the water muffler 760 is partitioned into an expansion chamber 761 and a resonator chamber 762 (this chamber 762 is also an expansion chamber), and to the expansion chamber 761, there are connected the exhaust pipe 53 coupled to the engine 20 and the exhaust/drainage pipe 54 opened outside the boat. As described above, the exhaust gas G and the cooling water W are introduced from the exhaust pipe 53 into the water muffler 760, and are discharged outside the boat from the water muffler 60 through the exhaust/drainage pipe 54.

In the water muffler 760, between the exhaust pipe 53 opened within the expansion chamber 761 and the exhaust/drainage pipe 54, there is provided a water restraining plate 763 on the upper side within the expansion chamber 761.

The resonator chamber 762 has a characteristic property that an amount of attenuation in a low frequency area (100 to 200 Hz) is great.

Reference numeral 764 designates a communication pipe for communicating between the expansion chamber 761 and the resonator chamber 762; and 765, a communication hole for communicating between the expansion chamber 761 and the resonator chamber 762.

This water muffler 760 has a first cylindrical body 770, a second cylindrical body 780, a third cylindrical body 790 and a disk 100.

In the first cylindrical body 770, its front surface 771 is blocked, and the rear surface 772 is opened. To the upper part of the first cylindrical body 770, there is connected a coupling pipe 773 for coupling the exhaust pipe 53 by welding or the like. On the rear surface 772, there is provided a disk 100. The disk 100 has a circumference portion flexed at right angles (the flexed portion is indicated by a reference numeral 101). A substantially lower half of the disk 100 has been punched in a semicircle as shown in FIG. 9(*b*), and this punched portion constitutes a semicircular aperture 102, and the upper portion forms the water restraining plate 763. The flexed portion 101 of the disk 100 is welded to an inner circumference portion of the aperture 772 of the first cylindrical body 770, whereby the disk 100 is joined with a rear part of the first cylindrical body 770.

In the second cylindrical body 780, its front surface 781 is opened. On the rear wall 782, there is provided a communication pipe 64 by welding or the like, and on the lower part thereof, there is bored a communication hole 765. Also, in the upper part of the second cylindrical body 780, there is connected a coupling pipe (this coupling pipe itself is the exhaust/drainage pipe) 783 for coupling the exhaust/drainage pipe 54 by welding or the like. A front circumference portion of such a second cylindrical body 780 is joined with the disk 100 (and/or the rear part of the first cylindrical body 770) by welding or the like, whereby the first cylindrical body 770 and the second cylindrical body 780 are joined with each other to form a single expansion chamber 761.

In the third cylindrical body 790, its front surface 791 is opened and the rear surface 792 is blocked. The front circumference portion of such a third cylindrical body 790 is joined with the rear circumference portion of the second cylindrical body 780 by welding or the like, whereby the resonator chamber 762 is formed.

To the third cylindrical body 790, there is connected a drainage pipe 766 by welding or the like, and to this drainage pipe 766, the bilge pipe 38 is connected. This bilge pipe 38 is, as described above, connected to the jet pump 30, which constitutes the bilge pump, via the bilge pipe 37.

Therefore, while the engine is operating (that is, while the jet pump 30 is being driven), water which is going to accumulate within the water muffler 760 is to be drained into a jet water flow due to the jet pump 30 through the bilge pipes 38 and 37. In this respect, at least one of the bilge pipes 37 and 38 is located above the water line.

An aperture 767 within the water muffler of the drainage pipe 766 has been opened between a bottom 760*a* within the water muffler and an upper end portion 784*a* of the aperture 784 within the water muffler of the exhaust/drainage pipe 783.

Also, an upper end 767*a* of the aperture 767 within the water muffler of the drainage pipe 766 is located at the substantially same height as a lower end portion 784*b* of the aperture 784 within the water muffler of the exhaust/drainage pipe 783, or a higher height.

In other words, the upper end 767*a* of the aperture 767 within the water muffler of the drainage pipe 766 is located substantially between the lower end portion 784*b* of the aperture 784 within the water muffler of the exhaust/drainage pipe 783 and the upper end portion 784*a* in a direction of the height.

In this respect, the aperture 784 within the water muffler of the exhaust/drainage pipe 783 shown has been obliquely opened, but when this is opened horizontally, the aperture 767 within the water muffler of the drainage pipe 766 is caused to be opened between the bottom 760*a* within the water muffler and the aperture 784 of the exhaust/drainage pipe 783. Also, the aperture 767 within the water muffler of the drainage pipe 766 shown has been obliquely opened, but when this is opened horizontally, the aperture 767 is caused to be opened at the substantially same height as the lower end portion 784*b* (when the aperture 784 within the water muffler is horizontal, the aperture 784) of the aperture 784 within the water muffler, or at a higher height.

In FIG. 9, W1 and W2 represent a water surface (water level) of water which is discharged and is accumulated within the water muffler 760 from the exhaust pipe 53 together with the exhaust gas when the engine 20 is in an idling state, and W1 indicates a water level when there is not provided the drainage pipe 766, and W2 indicates a water level when there is provided the drainage pipe 766.

In other words, if there is provided no drainage pipe 766, water will be accumulated up to the water level W1 in which the aperture 784 of the exhaust/drainage pipe 783 is substantially or completely blocked with water within the water muffler 760 when idling. In contrast, when there is provided the drainage pipe 766 as in the present embodiment, the water level lowers to the water level W2 which substantially coincides with the upper end 767*a* of the aperture 767 of the drainage pipe 766. Therefore, a state of affairs that the aperture 784 of the exhaust/drainage pipe 783 is blockaded with water will not occur.

In this respect, a lower end 103 (higher end than the aperture 102) of the water restraining plate 763 is located above the water surface W1, and the communication pipe 764 is also located above the water surface W1. The communication hole 765 is located below the water surface W2.

In such drainage structure of a water muffler as described above, since in a ship having a pump, equipped, in an exhaust system of the engine 20, with an expansion chamber 761 into which exhaust gas and water flow, and a water muffler having an exhaust/drainage pipe 783 for discharging the exhaust gas and water within this expansion chamber 761, the water muffler 760 is provided with a drainage pipe 766 and this drainage pipe 766 is connected to a pump 33, the water within the water muffler 760 is to be drained through the drainage pipe 766 by the pump 30 even when the engine 20 is in an idling state.

Thus, since the aperture 767 within the water muffler of this drainage pipe 766 has been opened between the bottom 760*a* within the water muffler and the upper end portion 784*a* of the aperture 784 within the water muffler of the exhaust/drainage pipe 783, a blockage, with water, of the aperture 784 within the water muffler of the exhaust/drainage pipe 783 disappears even when the engine 20 is in an idling state.

Therefore, according to this drainage structure of a water muffler, when an attempt is made to raise the number of revolutions of the engine 20 from an idling state by rotating the throttle lever of the steering wheel 13, water which is going to flow into the aperture 784 will not resist the exhaust, therefore, the number of revolutions of the engine 20 smoothly rises and the hull 11 can be smoothly accelerated.

Moreover, the water within the water muffler 760 is discharged also through the drainage pipe 766, and as a result, the exhaust/drainage pipes 54 and 783 can be made narrower that much, resulting in decreased exhaust noise.

Further, as the result of the exhaust/drainage pipes 54 and 783 being capable of being made narrower, it is possible to reduce an amount of water which flows backward from the exhaust/drainage pipes 54 and 783 and the water muffler 760 to the upstream side (engine 20 side) during capsizing of the small boat 10, and therefore, this structure becomes resistant to flooding due to capsizing. Accordingly, it becomes possible to reduce the capacity of the counter-flow prevention chamber 52.

Also, since the upper end 767*a* of aperture 767 within the water muffler of the drainage pipe 66 is located at the substantially same position as the lower end portion 784*b* of the aperture 784 within the water muffler of the exhaust/drainage pipe 783 or at a higher position, the predetermined amount of water (amount of water corresponding to water level W2) can be secured within the water muffler 760, and the water muffler 760 can be prevented from being excessively overheated.

Also, since the pump is constructed of a jet propulsion pump 30 to be driven by the engine 20, during an operation including idling time of the engine 20, the water within the water muffler 760 is to be drained in synchronism therewith, and it becomes possible to effectively control, to the water level W2, the water level within the water muffler 760 in synchronism with the operation of the engine 20.

Further, actual capacity of the expansion chamber of the water muffler 760 is increased by an amount corresponding to a portion that the water level lowers to W2, and to this expansion chamber 761, the exhaust pipe 53 coupled to the engine 20 and the exhaust pipe 54 opened outside the boat are made contiguous, whereby an attenuation operation against exhaust noise of the low frequency area can be improved. Also, within the water muffler 760, a resonator chamber 762 is partitioned and provided, whereby the exhaust noise of the low frequency area can be further reduced.

Moreover, since the interior of the water muffler 760 has been partitioned into the expansion chamber 761 and the resonator chamber 762, the resonator chamber 762 need not be provided separately from the water muffler, but the entire exhaust device can be also miniaturized. Accordingly, layout within the narrow boat is also facilitated and the cost can be also reduced.

Also, since between the exhaust pipe 53 opened within the expansion chamber 761 and the exhaust pipe 54, there is provided a water restraining plate 763 on the upper side within the expansion chamber 761, a water storminess is restrained by this water restraining plate 763 during capsizing, and as a result, a possibility of water flowing backward toward the engine side is further reduced.

As discussed above, the water muffler is provided with a drainage pipe and this drainage pipe is connected to a pump, the water within the water muffler is to be drained through the drainage pipe by the pump even while the engine is in an idling state.

Since the aperture within the water muffler of this drainage pipe has been opened between the bottom within the water muffler and the upper end portion of the aperture within the water muffler of the exhaust/drainage pipe, a blockage, with water, of the aperture within the water muffler of the exhaust/drainage pipe disappears even while the engine is in an idling state.

According to the drainage structure of a water muffler of the present invention, when an attempt is made to raise the engine speed from an idling state, water which is going to flow into the aperture will not become high exhaust resistance so that the engine speed is to smoothly rise.

Moreover, the water within the water muffler is also drained through the drainage pipe, and as a result, the exhaust/drainage pipe can be made narrower that much, resulting in reduced exhaust noise.

Further, as the result of the exhaust/drainage pipe being capable of being made narrower, it is possible to reduce an amount of water which flows backward from the exhaust/drainage pipe and the water muffler toward the upstream side (engine side) during capsizing, and therefore, this structure becomes resistant to capsizing.

Also, when the upper end of aperture within the water muffler of the drainage pipe is located at the substantially same height as the lower end portion of the aperture within the water muffler of the exhaust/drainage pipe or at a higher height, since the predetermined amount of water can be secured within the water muffler, it is possible to prevent the water muffler from being excessively overheated.

Also, when the pump is constructed of a jet propulsion pump to be driven by the engine, since during operation including idling time of the engine, the water within the water muffler is drained in synchronism therewith, it becomes possible to effectively control the water level within the water muffler in synchronism with an operation of the engine.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A drainage structure for an exhaust resonator of a watercraft comprising:

a pump for pumping water;

an exhaust system including a muffler and exhaust piping in fluid communication with an engine and being adapted to house cooling water, said exhaust piping including inlet and outlet piping connected to said muffler;

a resonator separate from and in fluid communication with said muffler, said resonator having an exhaust inlet and no separate exhaust outlet, said resonator being at least partially disposed and arranged below a water line during watercraft operation and including during an idle time of the engine; and a bilge pipe connecting the resonator to the pump.

2. A drainage structure according to claim 1, wherein the pump comprises a jet propulsion pump driven by said engine of said watercraft.

3. A drainage structure according to claim 1, wherein the pump comprises a bilge pump.

4. A drainage structure of a water muffler in a watercraft comprising:

a water muffler comprising:

an expansion chamber having a bottom into which exhaust gas and water flow;

an exhaust pipe connected to the expansion chamber for discharging exhaust gas and water from the expansion chamber, the exhaust pipe including an exhaust inlet and an exhaust outlet, the exhaust inlet disposed within the expansion chamber;

a drainage pipe including a drainage inlet and a drainage outlet, the drainage outlet of the draining pipe being connected to a pump and the drainage inlet positioned within the expansion chamber above the bottom and below an upper portion of the exhaust inlet;

wherein an upper portion of the drainage inlet is at substantially the same or greater distance from the bottom of the expansion chamber as a lower portion of the exhaust inlet is from the bottom of the expansion chamber.

5. The drainage structure according to claim 4, wherein the pump comprises a jet propulsion pump driven by an engine of the watercraft.

* * * * *